US005101723A

United States Patent [19]

Höll et al.

[11] Patent Number: 5,101,723

[45] Date of Patent: Apr. 7, 1992

[54] MECHANISM FOR THE ENGAGEMENT, DISENGAGEMENT AND ADJUSTMENT OF INKING AND DAMPING ROLLERS

[75] Inventors: Roland Höll, Weiterstadt; Herbert Rebel, Rodgau; Peter Hummel; Janko Despot, both of Offenbach am Main, all of Fed. Rep. of Germany

[73] Assignee: MAN Roland Druckmaschinen, Fed. Rep. of Germany

[21] Appl. No.: 690,061

[22] Filed: Apr. 23, 1991

[30] Foreign Application Priority Data

Apr. 24, 1990 [DE] Fed. Rep. of Germany ..... 4012965

[51] Int. Cl.[5] ..... B41F 31/34; B41G 27/36

[52] U.S. Cl. ..... 101/148; 101/352

[58] Field of Search ..... 101/352, 351, 349, 350, 101/357, 358, 207, 208, 209, 247, 137, 140, 139, 218, 182, 184, 185, 148

[56] References Cited

U.S. PATENT DOCUMENTS 3,538,849 11/1970 Bohman ..... 101/352
3,691,956 9/1972 James et al. ..... 101/352

FOREIGN PATENT DOCUMENTS 2155496 5/1972 Fed. Rep. of Germany .
1207883 2/1960 France .
63-264353 2/1989 Japan .
63-264354 2/1989 Japan .

*Primary Examiner*—J. Reed Fisher
*Attorney, Agent, or Firm*—Leydig, Voit & Mayer

[57] ABSTRACT

Adjustment means for engaging, disengaging and adjusting inking and damping rollers are provided in the inking and damping units of offset printing machines. The printing machine includes inking rollers supported on cam rollers which bear on cam discs situated axially parallel to the plate cylinder inside an arcuate housing. The cam discs are interconnected in such manner that they can be adjusted individually and they are also connected to the housing so as to be adjustable jointly. The housing is also pivotally connected to an adjustment drive by means of which it can be moved peripherally relative to the plate cylinder bearing to effectuate the engagement and disengagement position of the inking rollers.

10 Claims, 4 Drawing Sheets

MECHANISM FOR THE ENGAGEMENT, DISENGAGEMENT AND ADJUSTMENT OF INKING AND DAMPING ROLLERS

FIELD OF THE INVENTION

The present invention relates generally to a mechanism for the engagement, disengagement and adjustment of inking and damping rollers in a printing machine and more particularly concerns such a mechanism wherein adjusting cams can be moved individually or collectively to adjust the rollers.

BACKGROUND OF THE INVENTION

In printing machines, and particularly in offset printing machines, adjustment of the inking rollers relative to one another in inking units is extremely important. The same applies to the damping units used in offset printing. The adjustments of the rollers relative to one another and to the plate cylinder should be maintained as accurately as possible in the distribution of the ink within the inking unit and transfer to a plate cylinder, since the layer thicknesses of the ink are very thin. Care must be taken to ensure that the adjustment can be carried out simply and is lasting. Also, the same means often have to be used to enable a changeover to be carried out during operation, e.g. for starting up the machine or for interrupting the printing operation.

In the past, numerous solutions have been offered in this connection particularly with respect to inking rollers. As a rule, a plurality of inking and/or damping rollers are provided which have to be adjusted individually but which have to be engaged with and disengaged from the plate cylinder as a unit. FR-PS 1,207,883 describes a mechanism of this kind for a printing press. The inking rollers are disposed so as to be pivotable in pairs about distributor rollers of the inking unit. They bear against spring elements which maintain the end positions of the inking rollers in the engaged and disengaged positions, respectively. The positions are adjusted individually via wedge elements which can be moved from outside, via adjustment spindles, between the roller bearings and their respective supports. The inking rollers are supported on an engagement and disengagement cam which is situated centrally on the plate cylinder bearing and is rotatable there. For each inking roller the engagement and disengagement cam has a camming path with a low point for the engagement position and a high point for the disengagement position. Rotation of the engagement and disengagement cam causes the movement of the inking rollers to be initiated via the support elements and against the force of the spring elements for engagement and disengagement purposes.

The foregoing system has numerous adjustment facilities for the inking rollers both relative to the distributor rollers and to the plate cylinder. On the other hand, adjustment of the inking rollers is possible only individually by means of control elements terminating outside the press well. The control elements extend through the printing machine transmission area. Also, there are very large dimensions for the space required for installation as a result of the use of support elements and the construction of the engagement and disengagement cam as a ring which wraps around the plate cylinder bearing. The arrangement overall is obstructive to the general assembly and maintenance of the press in the area of the inking rollers and requires considerable expenditure for assembly and adjustment.

OBJECTS AND SUMMARY OF THE INVENTION

Accordingly, the primary aim of the invention is to provide an improved adjusting mechanism so as to make it extremely compact, user-friendly and simplified. More particularly, it is an object to provide a mechanism to carry out adjustment of all the inking rollers individually or collectively.

According to the present invention, the adjusting mechanism includes inking and damping rollers supported on cam discs disposed axially parallel to the plate cylinder inside an arcuate housing mounted on an eccentric bearing. The cam discs are interconnected such that they can be adjusted individually and they are connected to a guide plate in the housing so the cam discs can also be adjusted collectively. The housing is also pivotally connected to an adjustment drive by means whereby it can be moved peripherally relative to the plate cylinder bearing to effectuate engagement and disengagement of the inking and damping rollers.

A particularly advantageous feature of this is that the compact construction of the mechanism renders it possible for a joint adjustment or for the individual adjustment of the inking rollers to be carried out from a single location. Moreover, for damping rollers with the construction described it is possible for there to be different adjustments on each side. The mechanism according to the invention is completely independent of the machine transmission, i.e., it nowhere extends through the inking unit side wall. Also, the mechanism can be preassembled outside the machine and then be very easily fitted into the machine.

During press operation, the present invention makes it now possible for both the joint adjustment and the individual adjustment for controlling the inking rollers to be carried out from the same side of the inking unit. Also, the controls for the joint adjustment and the individual adjustment are identical so that operation is made easier for the operators. It is also an advantage that the control cams are disposed on individual cam discs. Thus they can be moved relative to one another and machined separately.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
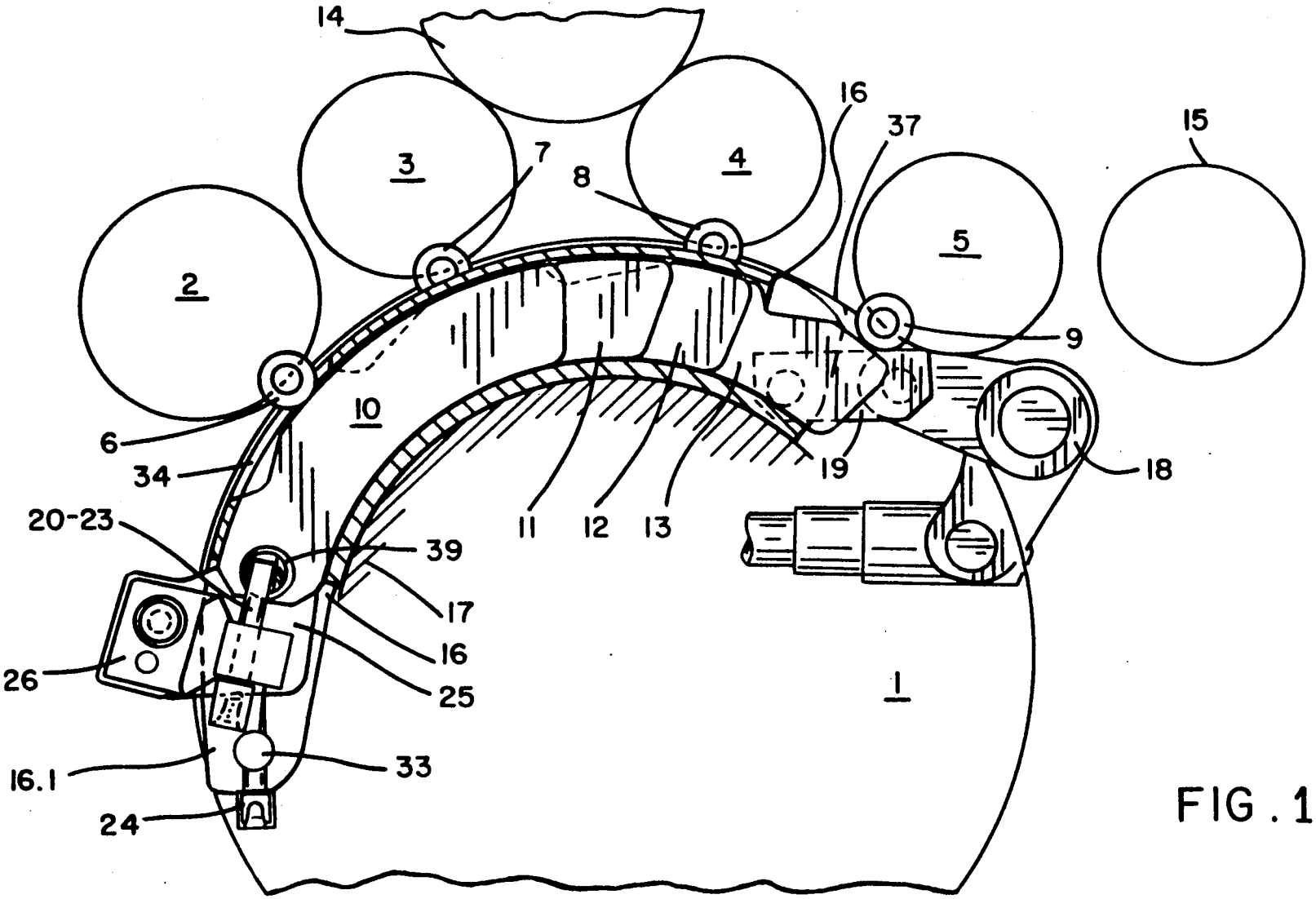
FIG. 1 is a somewhat schematic side elevation view of the adjusting mechanism of the present invention.

FIG. 1 is a general view of the adjusting mechanism of the present invention in somewhat schematic side elevation. Inking rollers 2, 3, 4 and 5 are associated with a plate cylinder 1 and their bearings are supported on cam discs 10, 11, 12 and 13 via cam rollers 6, 7, 8 and 9. The inking rollers 3, 4 and 5 are associated with distributor rollers 14 and 15 and, during the engagement and disengagement operation the inking rollers pivot around and move towards and away from the distributor rollers. The cam discs 10, 11, 12 and 13 are mounted inside a housing 16, which bears arcuately on the outside of a central collar of an eccentric bearing 17 of the plate cylinder 1.

At one end of the housing 16 a link 19 is pivotally suspended and connects the housing 16 to an adjustment drive 18 for engagement and disengagement of the inking rollers 2, 3, 4 and 5. At the other end, adjustment spindles 20, 21, 22 and 23 are disposed on the cam discs 10, 11, 12 and 13, respectively, and bear against a coupling element 26 connected to the housing 16. The coupling element 26, in turn, is movable itself with respect to the housing 16 by an adjustment spindle 24 on an elongation 16.1 of the housing 16.

The cam rollers 6, 7, 8 and 9 on the inking roller bearings each engage through apertures in the top of the housing 16. In this way, the individual cam discs 10, 11, 12 and 13 are adjustable inside the housing 16. Additionally, the cam discs 10, 11, 12 and 13 are jointly adjustable with respect to the housing 16, and the entire housing 16 can be pivoted to and fro by means of the adjustment drive 18, and in so doing it moves coaxially to the plate cylinder 1 on the periphery of the collar of the eccentric bearing 17.

Figure 2:
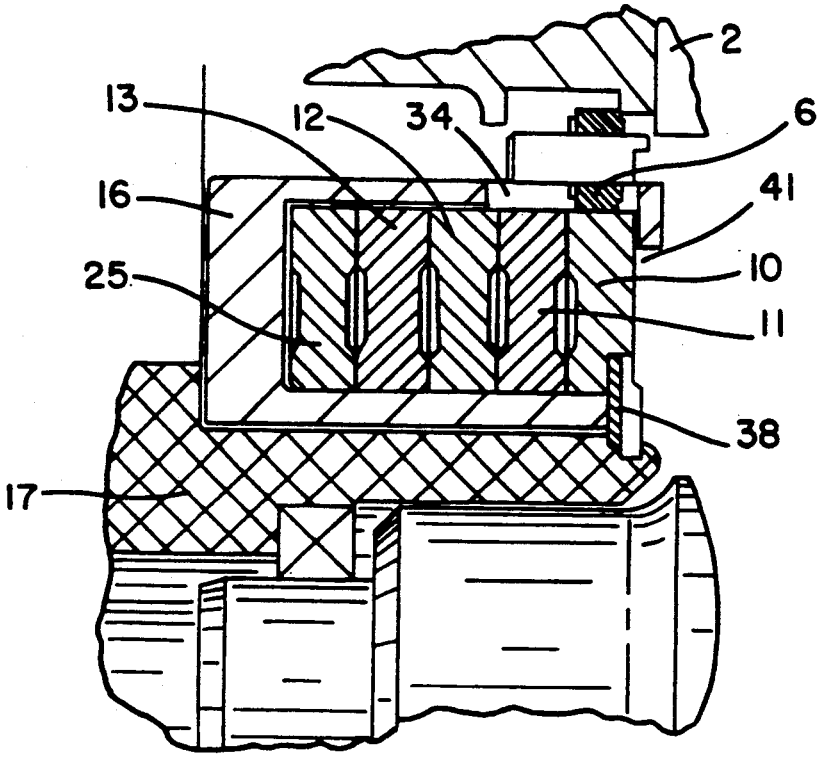
FIG. 2 is an enlarged, fragmentary cross-section through the mechanism of FIG. 1.

It will be seen from FIG. 2 that the housing 16 has on one side an opening 41 which is necessary in terms of conveniently producing the housing and which is also used to introduce the four cam discs 10, 11, 12 and 13, which are packed parallel to one another and axially close together. Basically all the cam discs 10, 11, 12 and 13 have the same construction, which will be explained in detail below.

Each cam disc 10, 11, 12 and 13 is provided respectively for one of the inking rollers 2, 3, 4 and 5. An additional guide segment 25 is also provided to which the coupling element 26 of the individual cam discs 10, 11, 12 and 13 is rigidly connected. By moving this guide segment 25 it is possible to shift all the cam discs 10, Il, 12 and 13 jointly. It will also be apparent from the drawing that the cam roller 6 bears on the cam disc 10 and supports the inking roller 2 via a shaft.

Figure 3:
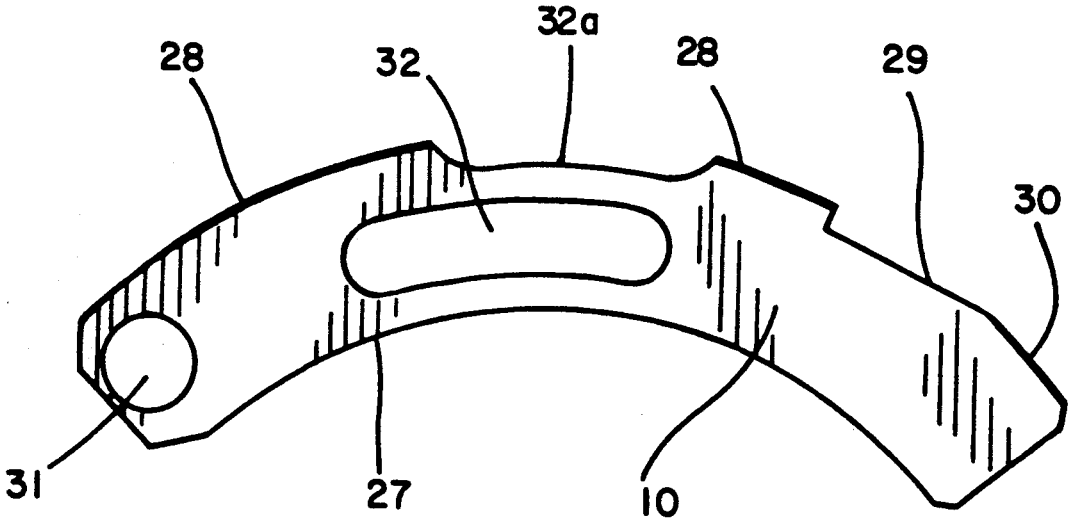
FIG. 3 is a side elevation of an individual cam disc.

FIG. 3 shows a cam disc 10 in detail. The cam disc 10 has guide surfaces 27 and 28 on the inside and outside to guide it inside the housing 16. Additional camming surfaces 29 and 30 are provided on the outside and are used for engagement and disengagement and also adjustment of the inking rollers. The high point acts as a disengagement cam 30 to define the disengagement position of the inking rollers at any time. The engagement cam 29 is formed as a linear cam and extends over a larger range so that it also provides suitable adjustment facilities for the inking rollers 2, 3, 4 and 5. All the cam discs 10, 11, 12 and 13 have the same pitch as this engagement cam to produce the same alteration for all the inking rollers 2, 3, 4 and 5 in response to common engagement alterations. A bore 31 is also provided in which the adjustment spindle 20 is mounted.

To improve the operation, a lubrication pocket 32 is provided laterally in each case and a recess 32*a* is provided at the outer periphery. The purpose of the latter is to prevent the shaft of an adjacent cam roller from bearing on the non-participating cam disc during engagement. This will also be apparent from FIG. 2. The cam discs 10, 11, 12 and 13 are axially secured by securing rings 38 directly on the central collar of the eccentric bearing 17 jointly with the housing 16.

Figure 4:
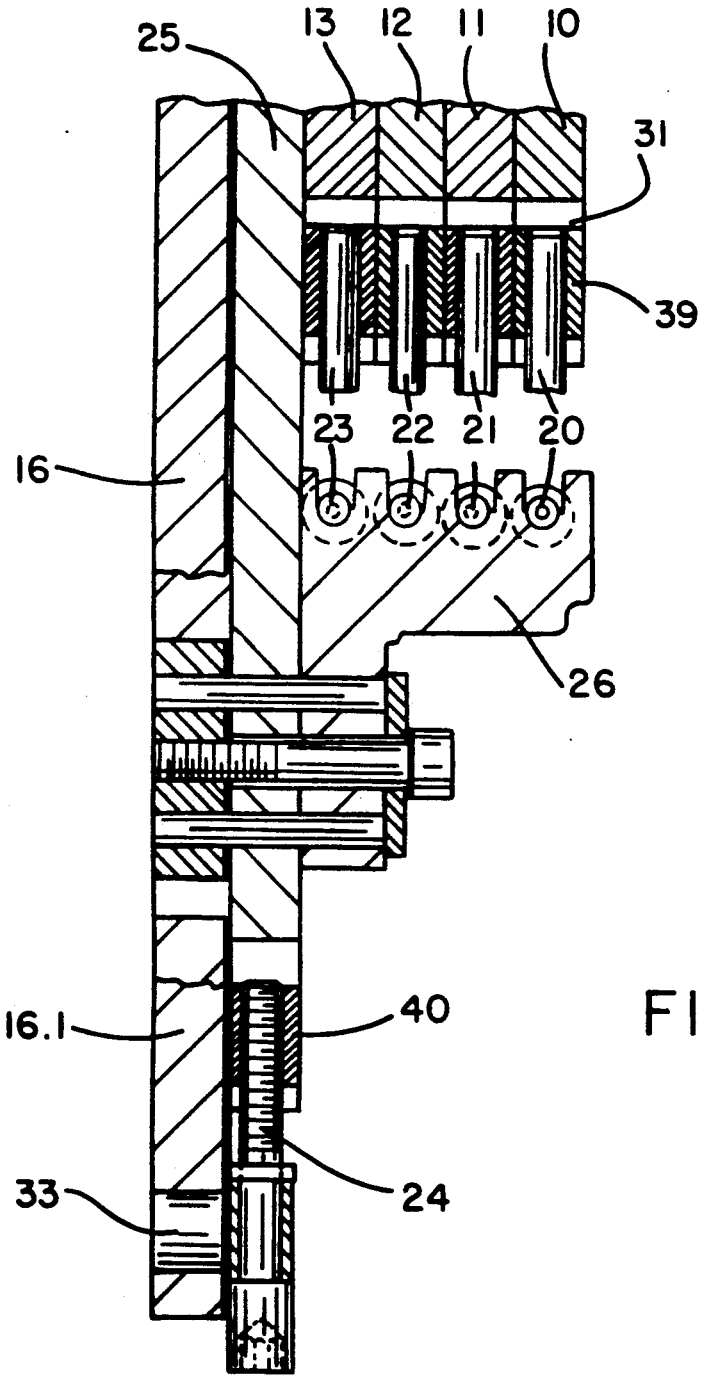
FIG. 4 is an enlarged, fragmentary view showing the mechanism adjustment means.

FIG. 4 shows the coupling of the cam discs 10, 11, 12 and 13, and once again the coupling element 26 is visible, which is disposed on the guide segment 25. The coupling element 26 is rigidly pinned there and has recesses in which the adjustment spindles 20, 21, 22 and 23 are engaged. These spindles are, in turn, pivotally connected to the cam discs 10, 11, 12 and 13. There should be the minimum clearance in the connection, which can be made by coupling discs 39 rotatably mounted in the bore 31. Another pivotally mounted coupling disc 40 is provided on the guide segment 25 and the adjustment spindle 24 is connected thereto. The latter is, in turn, pivotally connected to a pin 33 on the prolongation 16.1 of the housing 16. Thus, the coupling element 26, guide segment 25 and all the cam discs 10, 11, 12 and 13 can be jointly moved by means of the adjustment spindle 24 relative to the prolongation 16.1 and hence also relative to the housing 16.

Figure 5:
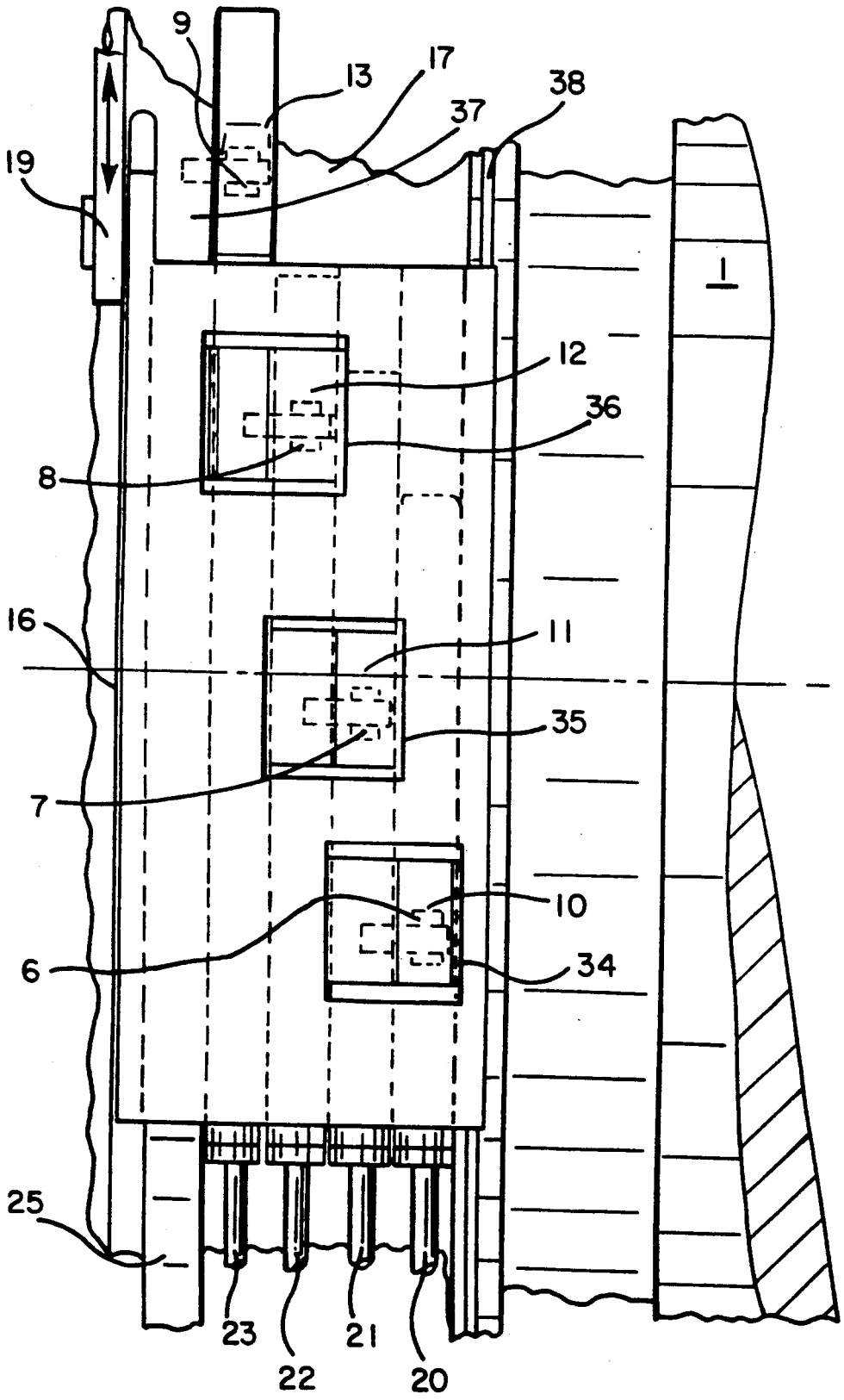
FIG. 5 is a plan view of the mechanism shown in FIG. 1.

FIG. 5 also shows the arrangement of the cam rollers 6, 7, 8 and 9 associated with the inking rollers 2, 3, 4 and 5 with respect to the cam discs 10, 11, 12 and 13. For this purpose, the drawing is a plan view of the housing 16. It will be apparent that the adjustment zones of the various inking rollers 10, 11, 12 and 13 are disposed peripherally of the plate cylinder 1 and axially side by side. This is apparent from recesses 34, 35, 36 and 37 arranged step-wise in the top of the housing 16. The cam rollers 6, 7, 8 and 9 of the inking roller bearings engage through these recesses to bear on the cam discs 10, 11, 12 and 13. The recesses 34, 35, 36 and 37 are in each case wider than just one disc width. Thus the cam rollers 6, 7, 8 and 9, which are shown in broken lines, can enter the recesses 34, 35, 36 and 37 by their shafts without obstruction when the inking rollers 2, 3, 4 and 5 are engaged or adjusted.

Operation and assembly are greatly improved by this arrangement. On assembly, the complete mechanism can be preassembled outside the machine and simply has to be fitted on the central collar 17 of the plate cylinder bearing inside the machine. There it is axially held by securing rings 38 and radially loaded by the spring biasing of the inking roller bearings. Peripherally the entire mechanism is held by the adjustment drive 18 and link 19 which, for installation, simply have to be engaged to the housing 16.

We claim as our invention:

1. A mechanism for engaging, disengaging and adjusting inking and damping rollers relative to a plate cylinder of a printing press having a press frame, said inking and damping rollers having bearing supported ends, said mechanism comprising, in combination, an eccentric bearing mounted on each end of the plate cylinder, said eccentric bearings each having an outer peripheral collar portion, an arcuate housing mounted on each of said peripheral collar portions, a plurality of axially adjacent, arcuately shaped, control cams movably mounted in each of said housings, means including a cam roller engaging each of said control cams for moving said bearing supported ends of at least selected ones of said inking and damping rollers, an arcuate guide element disposed in each of said housings parallel to said arcuate control cams, first means for connecting each of said control cams to said guide element, second means for connecting each of said guide elements to said housings, and third means for connecting each of said housings to said press frame, said third connecting means being adjustable by an adjustment drive to move each of said housings and said guide element and control cams contained therein as a unit with respect to said selected ones of said inking and damping rollers.

2. A mechanism according to claim 1 wherein said second connecting means is adjustable for collectively moving said guide element and said control cams contained in each of said housings with respect to said housings.

3. A mechanism according to claim 2 wherein said first connecting means is adjustable for individually moving each of said control cams contained in said housings with respect to said guide element.

4. A mechanism according to claim 3, wherein each of said first connecting means includes an adjusting spindle pivotally connected to one of said control cams and to a coupling element rigidly connected to said guide element.

5. A mechanism according to claim 2, wherein each of said second connecting means includes an adjusting spindle connected to said guide element and pivotally connected to said housing.

6. A mechanism according to claim 1 wherein recesses are provided in the top of said housing in a peripherally and axially offset manner for providing access to at least that part of said control cam which is associated with a respective cam roller.

7. A mechanism according to claim 1, wherein each of said control cams have guide surfaces on the inside and on the outside, and said outside guide surfaces each include a disengagement cam portion and a linear engagement cam portion.

8. A mechanism according to claim 1 wherein each of said control cams is provided with an axial guide surface on at least one side.

9. A mechanism according to claim 1 wherein said adjustment drive for said third connecting means is formed as a crank with a link connecting the crank to said housing on the side remote from the operator.

10. A mechanism according to claim 1 wherein said housing is secured on said peripheral collar portion solely by axial securing rings.

* * * * *